United States Patent [19]

Igashira et al.

[11] 4,164,261

[45] Aug. 14, 1979

[54] IGNITION APPARATUS FOR ROTARY PISTON ENGINE

[75] Inventors: Toshihiko Igashira, Toyokawa; Shunzo Yamaguchi, Okazaki; Hisasi Kawai, Toyohashi; Seiji Morino; Naoki Umeda, both of Okazaki, all of Japan

[73] Assignee: Toyota Jidosha Kogyo Kabushiki Kaisha, Toyota, Japan

[21] Appl. No.: 854,038

[22] Filed: Nov. 22, 1977

[30] Foreign Application Priority Data

Jun. 13, 1977 [JP] Japan ..... 52-69625
Sep. 2, 1977 [JP] Japan ..... 52-106017

[51] Int. Cl.[2] ..... F02B 53/12
[52] U.S. Cl. ..... 180/54 R; 123/179 BG
[58] Field of Search ..... 180/54 R; 123/145 A, 123/148 DS, 179 BG, 179 H, 210, 211

[56] References Cited

U.S. PATENT DOCUMENTS 3,551,686 12/1970 Koehler et al. ..... 123/179 H X
3,675,033 7/1972 Richard et al. ..... 123/179 H X
3,867,910 2/1976 Galonska ..... 123/211 X
3,970,049 7/1976 Yamaguchi et al. ..... 123/211
4,075,998 2/1978 Krauss et al. ..... 123/179 BG X

FOREIGN PATENT DOCUMENTS 1426173 1/1969 Fed. Rep. of Germany .
2158995 5/1972 Fed. Rep. of Germany .
2426323 11/1975 Fed. Rep. of Germany ..... 123/211

*Primary Examiner*—Joseph F. Peters, Jr.
*Assistant Examiner*—Michael Mar
*Attorney, Agent, or Firm*—Cushman, Darby & Cushman

[57] ABSTRACT

The temperature of a glow plug mounted on an epitorocoidal engine housing on a leading side of the torocoid minor axis of a rotary piston engine in the direction of the rotor rotation is sensed. When the sensed temperature exceeds a predetermined temperature within a temperature range which allows the ignition of air-fuel mixture, power to the glow plug is stopped whereby the life of the glow plug is extended and the power consumption is saved.

8 Claims, 8 Drawing Figures

IGNITION APPARATUS FOR ROTARY PISTON ENGINE

BACKGROUND OF THE INVENTION

The present invention relates to ignition apparatus for rotary piston engines, and more particularly to ignition apparatus for rotary piston engines which use glow plugs as ignition means for igniting the air-fuel mixture.

In a rotary piston engine, in general because of the complex contour of a combustion chamber, the combustion rate of the air-fuel mixture is low. Accordingly, it is necessary to ignite the air-fuel mixture at a very early time point before top dead center in order to save the expense of fuel. When a spark plug is used, however, gas cleaning in an ignition hole in which the spark plug is mounted is insufficient as the rotor is further from top dead center. For example, near 40° before top dead center (crank angle), it is difficult to ignite the air-fuel mixture by the influence of remaining gas. It is, therefore, practically difficult to establish very early ignition timing to the spark plug.

On the other hand, the inventors have experimentally proven that when an electrically heated plug is used instead of the spark plug, ignition occurs in effect between 50° to 30° before top dead center enabling very stable operation which greatly reduces fuel expense while maintaining a good emissions level.

However, the electrically heated plug inherently requires a certain preheating time after energy is applied to the plug for the igniting portion to reach a temperature allowing ignition of the air-fuel mixture. If cranking of the engine is effected during the preheating period, the ignition does not occur and the power is wasted resulting in shorter battery life. Accordingly, in the start-up of the engine, the start must be delayed until after a preheating period so that the plug is ready for ignition.

Further, in igniting the air-fuel mixture by the glow plug, it is necessary to maintain the glow plug at a temperature higher than an ignitable temperature (approximately 1000° C.) and at the same time it is desirable to prevent the glow plug from being heated above a necessary temperature in order to improve the durability of the glow plug. It is usually desirable to maintain the glow plug at a temperature below approximately 1100° C.

SUMMARY OF THE INVENTION

It is an object of the present invention to provide ignition apparatus for a rotary piston engine which allows proper operation of the engine, extends the life the ignition means (glow plug) and saves power consumption, by stopping the supply of power to the glow plug when the temperature of the glow plug mounted on the rotary engine exceeds a predetermined temperature.

It is another object of the present invention to provide ignition apparatus for a rotary piston engine which, in the start-up of the rotary engine equipped with a glow plug, causes an alarm lamp to be lit until the temperature of the glow plug exceeds a predetermined temperature to inform a driver of the unready condition of the engine for start-up or prevents a starting means (e.g. starter motor) from operating, or effects both operations for preventing wasteful cranking of the engine and extending the life of a battery.

It is another object of the present invention to provide ignition apparatus for a rotary piston engine which allows precise temperature control by sensing changes in the resistance of the heater of a glow plug by intermittently powering the glow plug at a fixed frequency.

It is another object of the present invention to provide ignition apparatus for a rotary piston engine having a good response characteristics by increasing a duty factor of power to a glow plug when a heater of the glow plug is being cooled by a stream of air-fuel mixture fed to a combustion chamber of the rotary engine and decreasing the duty factor of powering when the heater is being heated by the combustion of the air-fuel mixture.

It is another object of the present invention is to provide ignition apparatus which maintains the temperature of a glow plug mounted on a rotary piston engine at a proper temperature by controlling power to the glow plug such that the power to the glow plug is not increased by any temperature control signal beyond a possible maximum power required for the normal operation of the engine, for assuring long durability of the glow plug over an extended period.

DETAILED DESCRIPTION OF THE PREFERRED EMBODIMENTS

Figure 1:
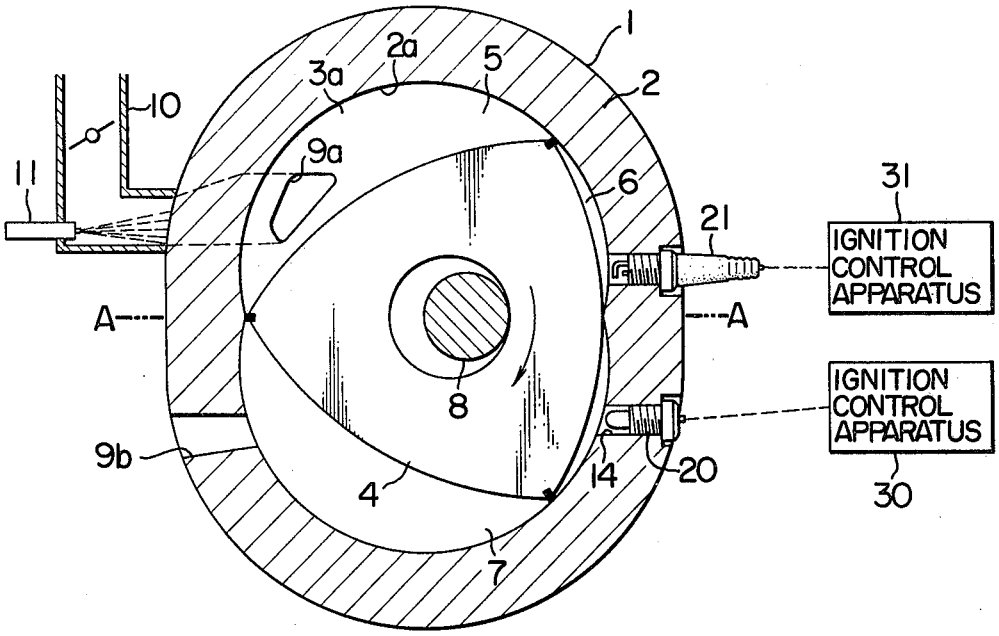
FIG. 1 is a sectional view of a rotary piston engine equipped with ignition apparatus of the present invention.

The present invention is now described in conjunction with the preferred embodiments shown in the drawings.

FIG. 1 shows a diagram of a rotary piston engine to which ignition apparatus of the present invention is applied. In FIG. 1, housing 1 comprises a peripheral wall 2 and side walls (not shown) connected to both edges thereof. An inner peripheral surface 2*a* of the peripheral wall 2 has a contour of epitorocoid curve and an inner peripheral surface 3*a* of the side wall is planar. Mounted within the housing 1 is a triangular rotor 4 which makes planetry rotary movement in the direction of an arrow defining three operating chambers 5, 6 and 7 with the housing 1. An output shaft 8 is coupled to the rotor 4 at the center thereof so that the movement of the rotor 4 is transmitted to the external through the output shaft 8. The housing 1 is formed with a suction part 9*a* and an exhaust port 9*b* at appropriate positions with the suction port 9*a* being connected to a suction pipe 10 and the exhaust port 9*b* being connected to an exhaust pipe (not shown). Mounted in the suction pipe 10 is a fuel feeding device, a fuel jet valve in the illustrated embodiment.

A glow plug 20 which constitutes a part of the present ignition apparatus is mounted in an ignition hole 14 formed in the peripheral wall 2 of the housing 1, and it is positioned at approximately one quarter of the distance from the end of the operating chamber 6 (on the leading side, as viewed in the direction of rotor rotation, with respect to a minor axis A—A of the torocoid curve) when the rotor 4 is at the top dead center (at the illustrated position). A spark plug 21 as an auxiliary ignition means is mounted on the trailing side of the glow plug 20 in the peripheral wall 2 of the housing 1. The glow plug 20 and the spark plug 21 are operated for the ignition operation by an ignition control apparatus 30 of the present invention and a well known ignition apparatus 31, respectively.

Figure 2:
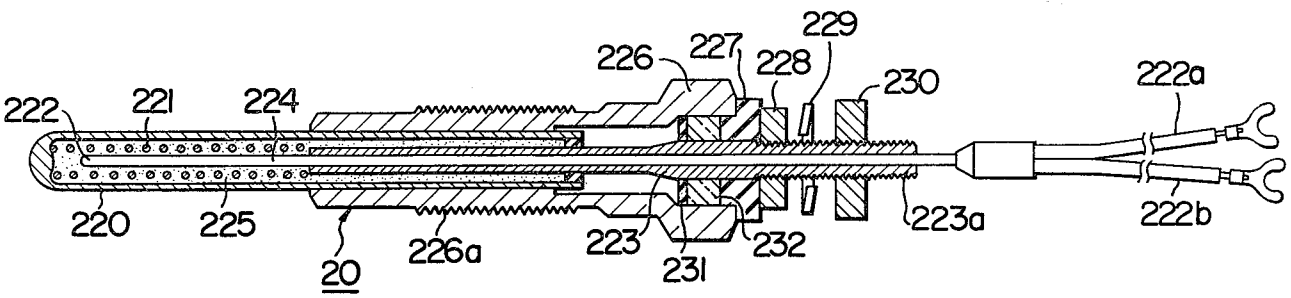
FIG. 2 is a sectional view of a glow plug used in a first embodiment of the present invention.

Referring to FIG. 2, the detail of the glow plug 20 is explained. In FIG. 2, numeral 221 denotes a heater coil made of nichrom wire wound in a coil, and it is housed within a casing (metal pipe) 220. One end of the heater coil 221 is welded to a metal pipe 220 made of stainless steel while the other end is joined by welding to a hollow tube 223 having a terminal thread 223*a*. A sheath 224 of a positive temperature coefficient thermistor (hereinafter referred to as PTC thermistor) is fitted in the hollow tube 223 with an end of the sheath being positioned close to the end of the pipe 220 so that the resistance of the PTC thermistor changes in accordance with the temperature at the end of the pipe 220.

Closely filled in the metal pipe 220 is heat resistive and electrically insulative powder such as magnecia to fix the heater coil 221 and the sheath 224 in position and electrically insulate the heater coil 221 from the sheath 224 and the metal pipe 220 from the sheath 224.

The PTC thermistor is composed of a semiconductor resistive element which is electrically insulated from the sheath 224 and buried within the sheath 224, and the change in the resistance of the resistive element is taken out through a pair of leads 222*a* and 222*b* which extend in the sheath 224.

Numeral 226 denotes a plug mode of a conductive metal having a mounting threaded portion 226*a* for mounting the same to the engine housing, and the plug 226 is hermetically joined by brazing or the like to the outer periphery of the metal pipe 220. A ring-shaped, electrically insulative plate 231 made of ceramic is positioned in a space between an open end of the plug 226 and the hollow tube 223, and glass (e.g. borosilicate glass) is filled in a space on the side of the open end of the plug 226, of the insulative plate 231, and the space between the plug 226 and the hollow tube 223 is hermetically sealed by heat resistive sealant 232 made of glass which has been melted to an appropriate temperature and then solidified. Numeral 227 denotes an electrically insulative bushing made of bakelite or the like, which is fitted in the open end of the plug 226 on the upper side of the heat resistive sealant 232 which seals the space between the side of the plug 226 facing the open end and the hollow tube 223. The electrically insulative bushing 227 is fixed against the movement by threadedly fitting a lock nut 228 to the terminal threaded portion 223*a* of the hollow tube 223. Numeral 229 denotes a spring washer and numeral 230 denotes a terminal nut which fixes a lead wire, not shown, through which the heater coil 221 is powered.

Figure 3:
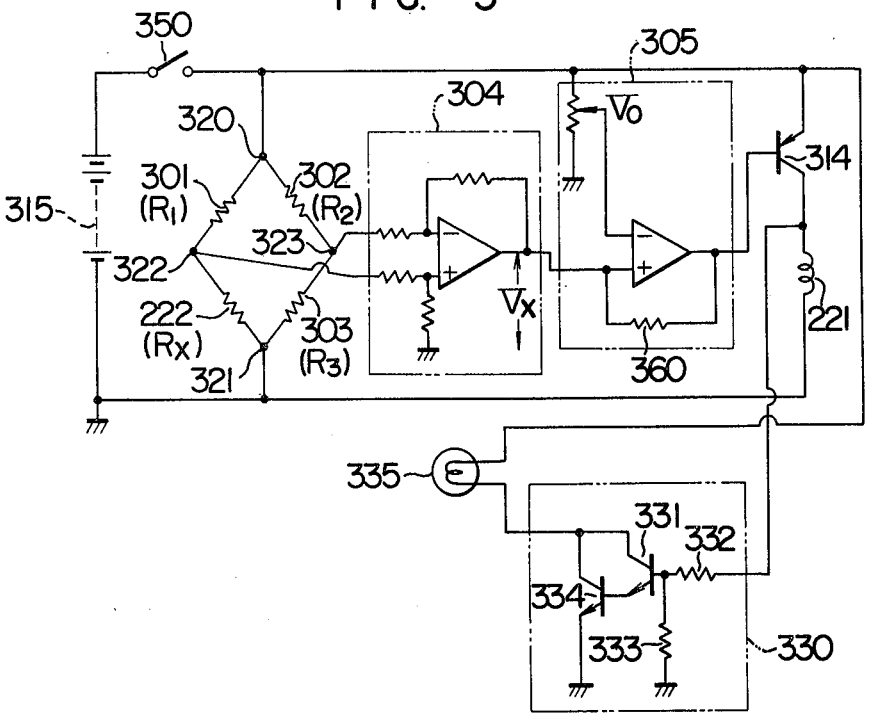
FIG. 3 is an electrical circuit diagram of an ignition apparatus of a rotary engine according to the first embodiment of the present invention.

Referring to FIG. 3, the detail of the ignition control apparatus is explained. In FIG. 3, the PTC thermistor 222 and three fixed resistors 301, 302 and 303 form a bridge circuit. The PTC thermistor is composed of a semiconductor device having a positive temperature coefficient in which the resistance (Rx) increases with the rise of the temperature. The three fixed resistors have resistances of $R_1$, $R_2$ and $R_3$, respectively.

A pair of junctions 320 and 321 of the bridge circuit are connected across a battery 315 while another pair of junctions 332 and 323 are connected to plus and minus input terminals of a differential amplifier 304, respectively, an output of which is connected to a non-inverting input terminal of a comparator 305 while a constant voltage $V_o$ is applied to an inverting input terminal of the comparator 305. Numeral 360 denotes a feedback resistor. An output of the comparator 305 is connected to a base of an output transistor 314 to control the conduction and non-conduction of the transistor 314. The comparator 305 includes a buffer circuit for fully operating the transistor 314. The heater coil 221 of the glow plug 20 is connected in series with the emitter-collector circuit of the transistor 314 and the series connection of the glow plug 20 and the transistor 314 is connected across a battery 315.

The collector of the transistor 314 is also connected to a switching circuit 330. A base of a transistor 331 to which an NPN transistor 334 is connected in Darlington configuration is connected to the collector of the transistor 314 through a resistor 332. A resistor 333 is connected between the base of the transistor 331 and ground. The collector-emitter circuit of the Darlington-connected transistor 334 is connected to the battery 315 through an alarm lamp 335. Numeral 350 denotes a key switch.

The operation of the ignition control apparatus thus constructed is now explained. When the key switch 350 is closed, power is supplied to the heater coil 221 of the glow plug 20 from the battery 315. The heater coil 221 is thus heated to heat the metal pipe 220 and the inside thereof (PTC thermistor 222). As the temperature of the glow plug 20 rises, the resistance of the PTC thermistor increases so that a potential difference occurs between the junction 322 of the bridge resistor 301 and the PTC thermistor 222 and the junction 323 of the bridge resistors 302 and 303. This potential difference is amplified by the differential amplifier 304 at a fixed amplification factor to produce the output $V_x$ of the differential amplifier. Since the potential at the junction 323 of the bridge resistors 302 and 303 is fixed, the output $V_x$ of the amplifier 304 and the temperature sensed by the PTC thermistor 222 are related by a given function. The comparator 305 compares the output voltage $V_x$ of the amplifier 304 with a fixed preset voltage $V_o$, which has been set to correspond to a temperature at which the ignition portion (the end of the metal pipe 220) is heated to turn red. When the voltage $V_x$ exceeds the preset voltage $V_o$, the output of the comparator 305 serves to block the external current, and when $V_x<V_o$, the output of the comparator 305 serves to flow the external current. Accordingly, when $V_x>V_o$, the power transistor 314 is cut off and when $V_x<V_o$, the power transistor 314 conducts. In response thereto, when $V_x>V_o$, the heater 221 is not powered and stops heating, and when $V_x<V_o$, it is powered for heating. Accordingly, by setting the voltage $V_o$ to the voltage corresponding to the temperature at which the ignition portion (the end of the metal pipe 220) is heated to turn red, the ignition portion can be maintained at a sufficiently heated condition to ignite the air-fuel mixture without continuously powering the heater 221.

In the rotary piston engine, as shown in FIG. 1, the glow plug 20 is mounted in the ignition hole 14 which is located at the compression side of the rotor housing 1. The ignition hole 14 tends to be filled with high temperature remaining gas. Accordingly, the glow plug 20 is exposed to the high temperature gas and hardly subjected to cooling by newly introduced gas. In other words, the glow plug 20 is capable of igniting the air-fuel gas without being continuously powered. According to the ignition apparatus of the present invention described above, the supply of power to the glow plug 20 is stopped when the temperature of the glow plug 20 is sufficiently high to allow the ignition of the air-fuel mixture by itself, and the power is supplied only when the temperature of the glow plug has fallen. As a result, the power is saved and the life of the glow plug is extended.

Furthermore, in FIG. 3, since the output of the comparator 305 is connected to the switching circuit 330, the alarm lamp 335 remains lit until the heater coil 221 is powered and the temperature of the glow plug 20 reaches the preset temperature. When the temperature of the heater coil 221 (and hence the temperature of the PTC thermistor 222) exceeds the preset temperature, $V_x$ becomes larger than $V_o$ so that the output of the comparator 305 assumes "1". That is, the transistor 314 is rendered non-conductive. Accordingly, both the transistors 331 and 334 are cut off and the alarm lamp 335 is turned off. When the output of the comparator 305 is switched to "1", a voltage is fed back to the plus input terminal thereof through the resistor 360 so that once the output assumes "1", the output next assumes "0" when the voltage $V_x$ reaches $V_o+\Delta V$ rather than $V_o$. The voltage $\Delta V$ corresponds to a hysteresis curve.

In the present embodiment, when the temperature of the ignition portion of the glow plug 20 is lower than the present temperature, the alarm lamp indicates that condition. Alternatively, the glow plug may be combined with a start circuit such that the operation of the starter is prevented to disable the start of the engine until the glow plug is enabled for ignition, or combination of both methods may be employed.

According to the ignition apparatus of the present invention described above, when the temperature of the ignition portion of the glow plug is too low to enable the ignition, that condition is indicated by the alarm lamp or the start of the engine is disabled. As a result, wasteful cranking of the engine can be prevented and the power can be saved. In the control apparatus illustrated in the present embodiment, even if the heater of the glow plug is broken, the alarm lamp is lit so that the condition of the glow plug can be indicated to the driver.

While the present embodiment particularlly describes the ignition control apparatus which uses the glow plug including the PTC thermistor for sensing the temperature of the glow plug, a glow plug which has been widely used in a diesel engine may be used as well in the present invention.

In general, where temperature control is carried out in accordance with the change in the resistance of a heat generating element, a certain voltage must be continuously applied to the heat generating element. This will be accomplished without difficulty in the linear control, but where the switching control is used a certain current must be fed in order to allow the detection of the resistance of the heat generating element during the cutoff period. This current must be very small since it is used to sense the resistance during the cutoff period and hence a ratio of the current during on period to the curent during off period is very high. As a result, the voltage across the heat generating element during the on period is slightly different from that during the off period in spite of the fact that the temperatures during the on period and off period are same. This voltage difference causes improper operation of the control circuit.

In an embodiment to be described hereinafter, the above problem is resolved by powering the heater element periodically and sensing the resistance of the heater element only during the on period to carry out the temperature control. Although higher powering frequency is preferable, it may be set depending on the response of the resistance of the heater element. In this embodiment, the duty factor may be increased when the heater element is being cooled by a stream of air-fuel mixture while the duty factor may be decreased when the heater element is heated by the combustion of the air-fuel mixture.

Figure 4:
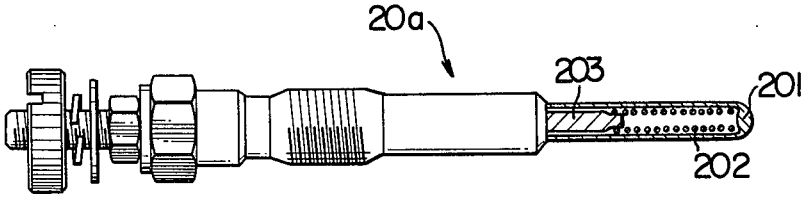
FIG. 4 is a partially sectional view of a glow plug used in second and third embodiments of the present invention.

Referring to FIG. 4, an example of a structure of a glow plug used in this embodiment is first explained. In a glow plug 20*a* shown in FIG. 4, an ignition portion 201 is common to a portion of the housing in which a coil 202 as the heater element is mounted. The coil 202 is powered through a central electrode 203 as an anode and the housing 201 as a cathode to generate heat. Magnesia is filled within the housing 201 to prevent the vibration of the coil 202 and conduct heat to the housing 201. The coil 202 is made of material close to a pure metal such as nickel or platinum whose resistance uniquely changes in accordance with the temperature thereof so that the temperature of the coil 202 can be sensed by sensing the resistance.

Figure 5:
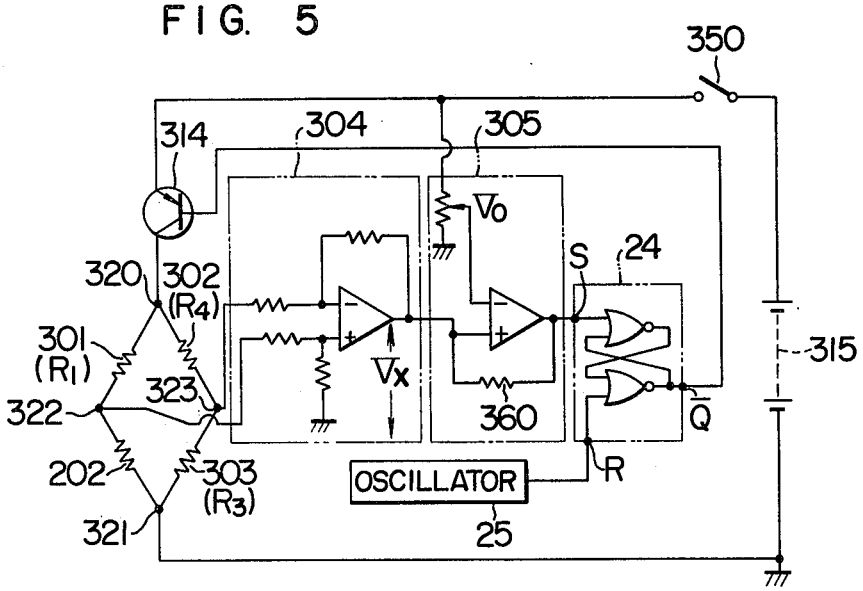
FIG. 5 is an electrical circuit diagram of an ignition apparatus of a rotary engine according to the second embodiment of the present invention.

Referring now to FIG. 5, a circuit configuration of a control apparatus 30 for controlling powering to the glow plug is explained. In FIG. 5, like numerals indicate like or corresponding parts to those of FIG. 3. The difference from the ignition control apparatus of FIG. 3 is primarily explained here.

The output of the comparator 305 is connected to a set terminal S of an R-S flip-flop circuit 24, a reset terminal R of which is connected to an oscillator 25 which produces pulses at a fixed frequency. A $\overline{Q}$ output terminal of the R-S flip-flop circuit 24 is connected to the base of the output transistor 314. As in the previous embodiment, the heater coil 202 of the glow plug 20*a* together with the three fixed resistors 301, 302 and 303 constitute the bridge circuit, the junctions 320 and 321 of which are connected across the battery 315 through the collector-emitter circuit of the transistor 314.

The operation of the second embodiment thus constructed is now explained below.

Figure 6:
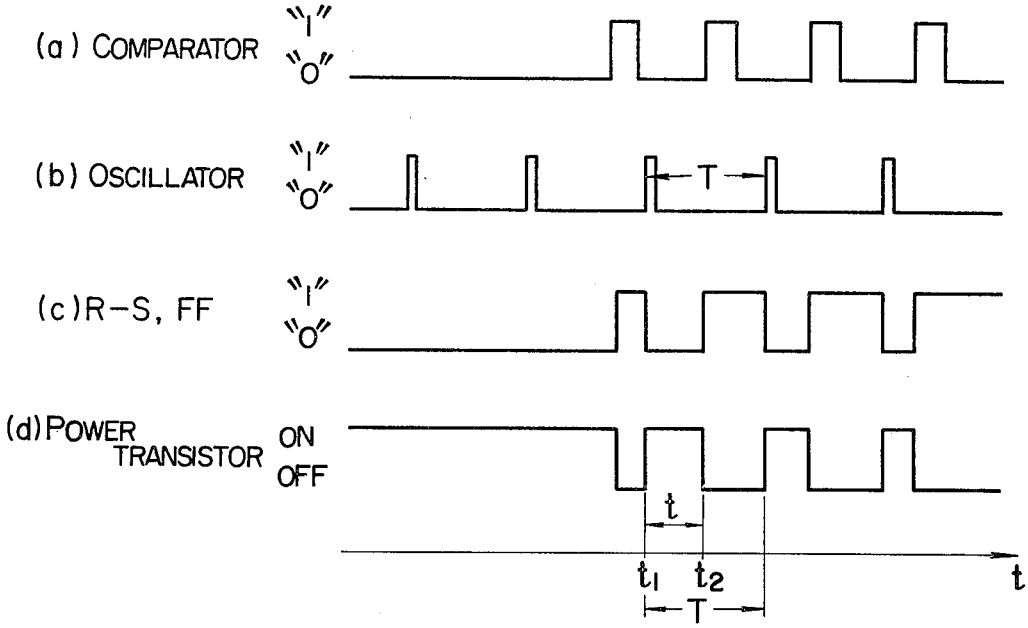
FIG. 6 shows waveforms for explaining the operation of the electrical circuit shown in FIG. 5.

When the key switch 350 is closed, the powering to the heater coil 202 starts. At the initial stage of the powering, the heater coil 202 has not been sufficiently heated so that the output $V_x$ of the amplifier 304 which amplifies the potential difference between the junctions 322 and 323 is lower than the preset input voltage $V_o$ to the comparator 305. Accordingly, the comparator 305 produces the "0" output as shown in FIG. 6(*a*) during $V_x<V_o$. This output is applied to the set terminal S of the flip-flop circuit 24.

The oscillator 25 produces the pulses at the fixed frequency as shown in FIG. 6(*b*), which pulses are applied to the reset terminal R of the flip-flop circuit 24. When a "1" level pulse is applied to the reset terminal R of the flip-flop circuit 24, the $\overline{Q}$ output terminal produce a "0" level signal which is applied to the base of the output transistor 314 so that the heater coil 202 is powered.

The output of the $\overline{Q}$ output terminal of the flip-flop circuit 24 remains at "0" level until the output of the comparator 305 switches from "0" to "1", that is, until the resistance of the heater coil 202 due to the temperature rise exceeds the preset value. Accordingly, the heater coil 202 is powered continuously until the ignition portion 201 of the glow plug 20*a* has been heated to turn red to reach the temperature to enable the ignition of the air-fuel mixture.

As the temperature of the glow plug 20*a* rises, the voltage $V_x$ eventually becomes larger than $V_o$, when the output of the comparator 305 is switched from "0" to "1" as shown in FIG. 6(*a*). As a result, the $\overline{Q}$ output of the flip-flop circuit 24 is switched from "0" to "1" as shown in FIG. 6(*c*) and the output transistor 314 is switched from on to off as shown in FIG. 6(*d*). Accordingly, the powering to the heater coil 202 is stopped.

Thereafter, when a pulse from the oscillator 25 is applied to the reset terminal of the flip-flop circuit 24, the output at the $\overline{Q}$ output terminal thereof is switched from "1" to "0" and the powering to the heater coil 202 is started again. In this manner, the powering to the heater coil 202 is intermittently carried out to effect temperature control of the glow plug 20*a*.

Since the power loss in the present embodiment mainly occurs by the voltage drop of the emitter-collector saturation voltage of the switching transistor, the power loss is much smaller than that in the linear control (continuous powering control). It should be understood that no delay of response is included because the temperature is sensed by the resistance of the heater element itself.

Furthermore, in the intermittent powering control of the present invention, the heater coil 202 is powered at the interval T, that is, the powering is started at the time $t_1$ in FIG. 6 and terminated when the time period t has been elapsed, when the output of the comparator 305 is reversed at the time $t_2$. Since the time period t changes depending on the operating condition of the heater element (glow plug 20*a*) and hence the duty factor t/T of the powering to the heater coil 202 changes depending on the operating condition, proper temperature of the glow plug can be maintained.

Figure 7:
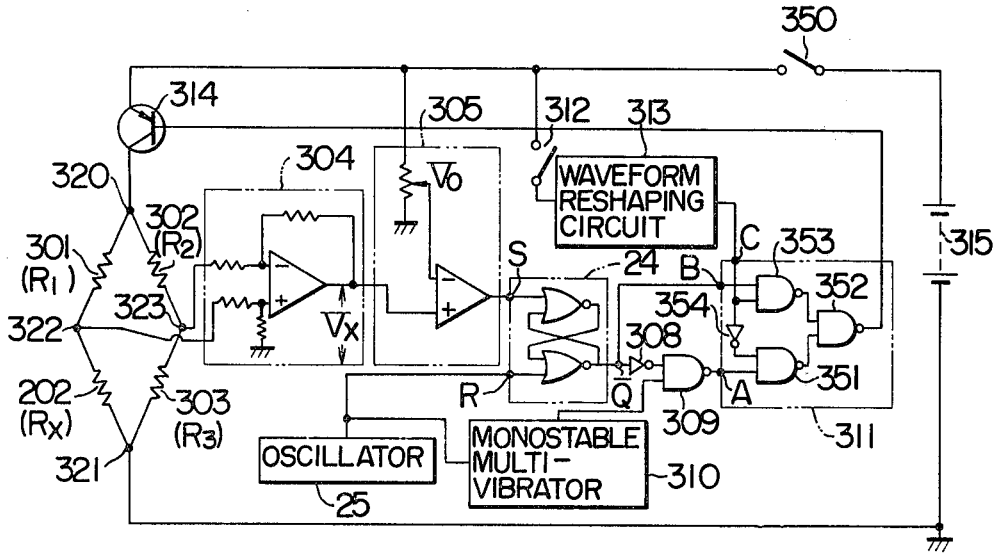
FIG. 7 is an electrical circuit diagram of an ignition apparatus of a rotary engine according to the third embodiment of the present invention.

Referring to FIG. 7, a third embodiment of the present invention is explained. Like in the previous embodiment, the present embodiment employs the glow plug 20*a* shown in FIG. 4. In FIG. 7, like numerals indicate like or corresponding parts to those in FIG. 5. Therefore, the difference from the ignition control apparatus of FIG. 5 is mainly described here.

The $\overline{Q}$ output terminal of the R-S flip-flop circuit 24 is connected to one input terminal of a NAND gate 309 through an inverter 308, and an output of the NAND gate 309 is connected to an input terminal A of a select circuit 311. An output of a monostable multi-vibrator 310 is connected to the other input terminal of the NAND gate 309, the monostable multivibrator 310 producing pulses of a fixed duty factor at a fixed frequency in response to pulses at a fixed frequency from the oscillator 25.

The select circuit 311 comprises NAND gates 351, 352 and 353 and an inverter 354, and the other input terminal B thereof is connected to the $\overline{Q}$ output terminal of the R-S flip-flop circuit 24. Numeral 312 denotes a starter switch which is connected to a starter motor, not shown and to a third input terminal C of the select circuit 311 through a well known shaping circuit 313, which applies a "1" level signal to the input terminal C when the starter switch 312 is closed.

Figure 8:
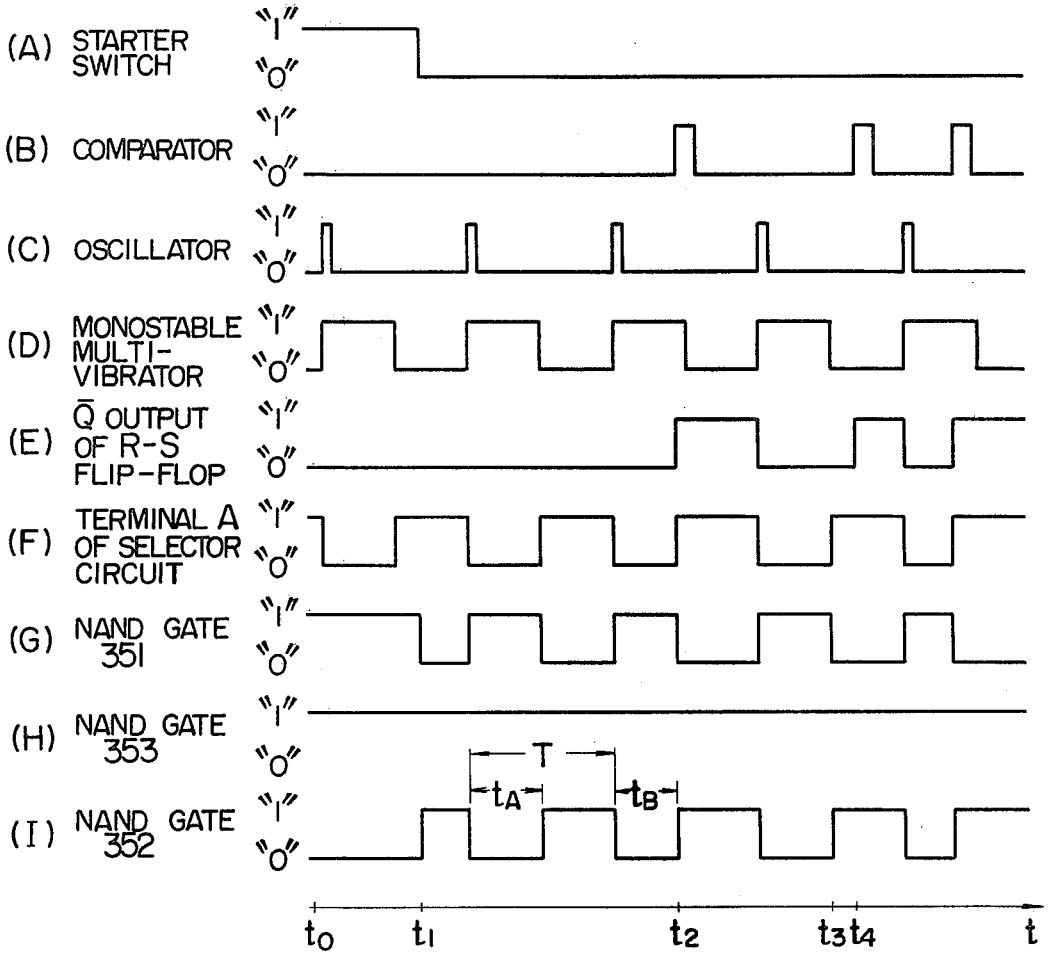
FIG. 8 shows waveforms for explaining the operation of the electrical circuit shown in FIG. 7.

The operation of the third embodiment thus constructed is explained with reference to FIG. 8.

When the key switch 350 and the starter switch 312 are closed simultaneously at the time $t_o$, a "1" level signal as shown in FIG. 8(A) is applied to the input terminal C of the select circuit 311. On the other hand, the flip-flop circuit 24 has been reset by a pulse from the oscillator 25 and the $\overline{Q}$ output terminal thereof produces a "0" level signal, which is applied to the input terminal B of the select circuit 311. The NAND gate 353 of the select circuit 311 receives the inputs ("0" level and "1" level signals) at the input terminals B and C to produce a "1" level signal which is applied to one input terminal of the NAND gate 352 (see FIG. 8(H)). Since the NAND gate 351 receives a "0" level signal through the inverter 354, it applies a "1" level signal to the other input terminal of the NAND gate 352 (see FIG. 8(G)). Accordingly, the NAND gate 352 of the select circuit 311 produces a "0" level signal (FIG. 8(I)), which is applied to the output transistor 314, which in turn is rendered conductive to start the powering to the heater coil 202 of the plow plug 20*a*. The powering to the heater coil 202 continues until the time $t_1$ is reached, that is, during the powering to the starter motor. When the starter switch 312 is opened, a "1" level signal is applied to one input of the NAND gate 351 through the inverter 354. Thus, the NAND gate 351 produces pulses as shown in FIG. 8(G) after the time $t_1$. The NAND gate 353 continues to produce the "1" level signal after the time $t_1$. Thus, the NAND gate 352 gates the pulse of the NAND gate 351 so that the heater coil 202 is intermittently powered after the time $t_1$. The maximum duty factor in the intermittent powering is determined by the pulses of the monostable multivibrator 310, and the duty factor $t_A/T$ has been set to correspond to a possible maximum power in a normal operation of the engine. Therefore, no unnecessarily large power is supplied to the heater coil 202 of the glow plug 20*a* and hence the durability of the glow plug is improved.

When the temperature of the glow plug reaches the preset temperature at the time $t_2$, the powering to the heater coil 202 is stopped at that moment so that the powering period $t_B$ to the heater coil 202 becomes shorter than $t_A$. On the other hand, if it is sensed at the time $t_4$ that the temperature of the glow plug 20*a* has reached the preset temperature, the temperature of the glow plug 20*a* does not rise beyond the preset temperature because the powering to the heater coil 202 has been stopped at earlier time $t_3$. Even if the output of the comparator 305 is not reversed by some reason in spite of the fact that the temperature of the glow plug 20*a* has reached the preset temperature, the temperature of the glow plug is maintained at the preset temperature because the powering to the heater coil 202 occurs intermittently at the duty factor $t_A/T$.

The key switch 350 may be closed prior to the start of the engine to preheat the glow plug in preparation for the start of the engine. In sensing the start of the engine, instead of using the starter switch, a manual switch may be used, which is closed during the heating of the glow plug in preparation for the start of the engine by the closure of the key switch while removing the limitation to the maximum power to the glow plug. In this case, the switch 312 shown in FIG. 7 may be replaced by a relay and a timer is separately provided to keep the relay on for a given time period (several seconds) after the turn-on of the main switch so that the limitation to the power at the start of the engine can be removed.

While the present embodiment illustrates the temperature control of the glow plug by varying the duty factor of the powering to the glow plug, it should be understood that the durability of the glow plug can be improved by varying the voltage applied to the glow plug or the frequency of powering while limiting the maximum applied voltage or maximum frequency.

As described hereinabove, according to the present invention, since the maximum power supplied to the glow plug is limited by the power limiting means, the power is supplied to the glow plug within the safety limit even if sprious signal such as noise occurs. Accordingly, the glow plug is prevented from overheating, which would otherwise shorten the service-life.

At the time of start of the engine, the limitation to the power supply is removed as desired or automatically so that the power is supplied at the maximum rate until the temperature of the glow plug reaches the ignitable temperature. In this manner, rapid start of the engine is attained.

What is claimed is:

1. An ignition apparatus for a rotary piston engine comprising:

a glow plug mounted in an engine housing of epitorocoid shape on a leading side of the torocoid minor axis as viewed in the direction of engine rotation;

means for energizing said glow plug in response to a trigger pulse signal of fixed frequency; and ignition control means for sensing the temperature of said glow plug and for stopping power to said glow plug when the sensed temperature exceeds a present temperature in a temperature range within which air-fuel mixture can be ignited, said ignition control means including means for sensing a change in a resistance of a heater coil of said glow plug to intermittently power said heater coil.

2. An ignition apparatus for a rotary piston engine according to claim 1, wherein said ignition control means includes means for an alarm when the temperature of said glow plug is below said preset temperature.

3. An ignition apparatus for a rotary piston engine according to claim 1, wherein said ignition control means includes means for disabling the start of said engine when the temperature of said glow plug is below said preset temperature.

4. An ignition apparatus for a rotary piston engine according to claim 1, wherein said ignition control means includes means for varying a duty factor of the intermittent powering in accordance with the resistance of said heater coil.

5. An ignition apparatus for a rotary piston engine according to claim 1, wherein said ignition control means includes means for limiting the duty factor of the intermittent powering to be lower than a predetermined value irrespective of the resistance of said heater coil.

6. An ignition apparatus for a rotary piston engine according to claim 1, wherein said ignition control means includes means for stopping the intermittent powering to said heater coil thereby causing continuous powering at the time of the start of the engine.

7. An ignition apparatus for a rotary piston engine having a housing with an epitorocoidal inner surface, a rotor mounted in said housing for forming at least one working chamber with said inner surface, a suction port for introducing an air-fuel mixture into said working chamber and an exhaust port for exhausting the residual gas from said working chamber, comprising:

a glow plug mounted in said housing to expose its end into said working chamber at a leading side of the minor axis of said epitorocoidal inner surface as said piston rotates, said glow plug having a built-in heater element for heating and for sensing the temperature thereof as the amount of resistance thereacross, an ignition control circuit connected with said glow plug for energizing said heater element in accordance with the signal from said heater element, said ignition control circuit including means for generating a series of pulses at a fixed frequency, means connected with said heater element for generating a signal at each time when the resistance of said heater element exceeds a predetermined value, and means connected with said heater element, pulse generating means and signal generating means for generating driving pulses which are defined by said signal from said signal generating means and said pulses from said pulse generating means to energize said heater element.

8. An ignition apparatus for a rotary piston engine having a housing with an epitorocoidal inner surface, a rotor mounted in said housing for forming at least one working chamber with said inner surface, a suction port for introducing an air-fuel mixture into said working chamber and an exhaust port for exhausting the residual gas from said working chamber, comprising:

a glow plug mounted in said housing to expose its end into said working chamber at a leading side of the minor axis of said epitorocoidal inner surface as said piston rotates, said glow plug having a built-in heater element for heating and for sensing the temperature thereof as the amount of resistance thereacross, an ignition control circuit connected with said glow plug for energizing said heater element in accordance with the signal from said heater element, said ignition control circuit including an oscillator for generating pulses at a predetermined frequency, a differential amplifier for comparing the resistance of said heater element with a fixed resistance to generate a first signal, a comparator coupled with said differential amplifier for comparing said first signal with a fixed signal to generate a second signal, a flip-flop circuit connected with said comparator and oscillator for being set and reset by said signal from said comparator and said pulses from said oscillator to generate driving pulses defined by said set and reset signals, and a power transistor for energizing said heater element in accordance with said driving pulses.

* * * * *